US009745784B1

(12) United States Patent
Lawrence

(10) Patent No.: US 9,745,784 B1
(45) **Date of Patent: *Aug. 29, 2017**

(54) TILT WINDOW LATCH AND METHOD

(71) Applicant: Barry G. Lawrence, Thomasville, NC (US)

(72) Inventor: Barry G. Lawrence, Thomasville, NC (US)

( * ) Notice: Subject to any disclaimer, the term of this patent is extended or adjusted under 35 U.S.C. 154(b) by 81 days.

This patent is subject to a terminal disclaimer.

(21) Appl. No.: 14/836,237

(22) Filed: Aug. 26, 2015

Related U.S. Application Data

(63) Continuation of application No. 13/479,456, filed on May 24, 2012, now Pat. No. 9,163,437.

(51) Int. Cl.

| | |
|---|---|
| ***E05C 1/02*** | (2006.01) |
| ***E05C 1/14*** | (2006.01) |
| ***E05C 9/04*** | (2006.01) |
| ***E05C 9/02*** | (2006.01) |
| ***E05C 17/44*** | (2006.01) |
| ***E05C 7/04*** | (2006.01) |
| ***E05B 65/10*** | (2006.01) |
| *E05C 1/06* | (2006.01) |
| *E05C 1/12* | (2006.01) |
| *E05C 19/00* | (2006.01) |
| *E05C 3/02* | (2006.01) |

(52) U.S. Cl.
CPC ..... *E05C 1/14* (2013.01); *E05B 65/1033* (2013.01); *E05C 7/045* (2013.01); *E05C 9/021* (2013.01); *E05C 9/041* (2013.01); *E05C 17/443* (2013.01)

(58) Field of Classification Search
CPC ... Y10T 292/1018; E05C 9/041; E05C 9/021; E05C 9/066; E05C 7/045; E05C 17/443; Y10S 292/06; Y10S 292/07; Y10S 292/20; Y10S 292/33
USPC ..... 292/137, 142, 172, 279, 280, 240, 292/DIG. 20, DIG. 35, DIG. 47
See application file for complete search history.

(56) References Cited

U.S. PATENT DOCUMENTS

| | | | | | |
|---|---|---|---|---|---|
| 906,010 | A | * | 12/1908 | Gray | E05B 85/28 292/280 |
| 1,060,444 | A | * | 4/1913 | Feola | E05B 63/0017 70/134 |
| 1,464,458 | A | * | 8/1923 | Whartenby | E05B 65/0057 27/35 |
| 3,478,919 | A | * | 11/1969 | Turpen | B65D 88/126 220/1.5 |
| 4,095,829 | A | | 6/1978 | Van Klompenburg | |
| 4,368,905 | A | * | 1/1983 | Hirschbein | E05B 65/1046 292/22 |
| 4,476,700 | A | * | 10/1984 | King | E05C 9/041 292/39 |
| 4,848,811 | A | * | 7/1989 | Laufenburg | E05C 9/021 292/142 |

(Continued)

*Primary Examiner* — Kristina Fulton
*Assistant Examiner* — Faria Ahmad
(74) *Attorney, Agent, or Firm* — Tuggle Duggins P.A.; Blake Hurt

(57) ABSTRACT

A latch and method for a double sash tilt window includes a locking mechanism and a rack having proximal and distal ends. The proximal end of the rack is connected to the locking mechanism while the distal end of the rack is affixed to a slide bolt. The latch also includes a cam and a gear, the cam positioned on the gear and the gear enmeshed with the rack so that rotating the gear operates the slide bolt which prevents the window from tilting.

18 Claims, 4 Drawing Sheets

(56) References Cited

U.S. PATENT DOCUMENTS 5,161,839 A 11/1992 Piltingsrud et al.
5,715,631 A * 2/1998 Kailian ..... E05B 65/0876 292/172
5,951,068 A * 9/1999 Strong ..... E05B 65/0858 292/112
6,076,304 A * 6/2000 Carrier ..... E05F 11/10 49/336
6,485,067 B1 * 11/2002 Root ..... E05C 9/021 292/142
6,502,438 B1 * 1/2003 Miller ..... E05B 17/2084 292/142
6,517,127 B1 * 2/2003 Lu ..... E05B 47/0012 292/142
6,540,270 B1 * 4/2003 Reddmann ..... E05B 81/22 292/201
6,817,142 B2 11/2004 Marshik
6,871,884 B2 * 3/2005 Hoffmann ..... E05C 9/041 292/112
7,036,274 B2 * 5/2006 Carrier ..... E05C 9/021 292/160
7,147,255 B2 * 12/2006 Goldenberg ..... E05B 65/0841 292/240
7,185,927 B2 3/2007 Talukdar et al.
7,237,811 B1 * 7/2007 Lawrence ..... E05B 17/0012 292/172
D553,947 S 10/2007 Flory
D554,473 S 11/2007 Flory
D554,971 S 11/2007 Flory
D554,973 S 11/2007 Flory
7,481,470 B2 * 1/2009 Eenigenburg ..... E05B 5/003 292/175
7,490,873 B1 2/2009 Ricke et al.
7,588,271 B1 9/2009 Lawrence
7,963,577 B2 6/2011 Wolf
8,132,369 B2 3/2012 Pettit et al.
8,226,130 B2 * 7/2012 Alfredsson ..... E05B 15/0006 292/137
8,978,303 B1 * 3/2015 Rogers ..... E05D 15/22 292/175
9,163,437 B1 * 10/2015 Lawrence ..... E05C 1/04
2002/0093205 A1 * 7/2002 Schultz ..... E05B 65/0817 292/163
2003/0110698 A1 * 6/2003 Polowinczak ..... E05B 5/003 49/181
2004/0239121 A1 * 12/2004 Morris ..... E05B 13/004 292/39
2004/0245784 A1 * 12/2004 Tsai ..... E05B 65/0858 292/51
2005/0097823 A1 * 5/2005 Marshik ..... E05B 65/0835 49/449
2005/0104380 A1 * 5/2005 Cho ..... E05B 83/30 292/33
2005/0198905 A1 * 9/2005 Carrier ..... E05C 9/021 49/394
2006/0244269 A1 * 11/2006 Rotondi ..... E05B 5/00 292/213
2006/0244270 A1 * 11/2006 Rotondi ..... E05B 63/20 292/213
2007/0158951 A1 * 7/2007 Ramsauer ..... E05C 9/1875 292/39
2009/0265996 A1 * 10/2009 Flory ..... E05B 65/0841 49/394
2009/0265997 A1 * 10/2009 Flory ..... E05B 13/004 49/394
2009/0267356 A1 * 10/2009 Vanhellemont ..... E05B 63/0004 292/96
2010/0083578 A1 4/2010 Albrecht
2010/0132262 A1 * 6/2010 Talpe ..... E05B 65/1006 49/394
2010/0132263 A1 * 6/2010 Flory ..... E05B 65/0841 49/395
2013/0214545 A1 * 8/2013 Wolf ..... E05C 3/046 292/241

* cited by examiner

TILT WINDOW LATCH AND METHOD

This is a continuation of and claims benefits under pending prior application Ser. No. 13/479,456 filed 24 May 2012, now U.S. Pat. No. 9,163,437, which is incorporated by reference in its entirety herein.

FIELD OF THE INVENTION

The invention herein pertains to a window latch and particularly pertains to a tilt window locking mechanism with a gear engaging a rack that operates a distal sliding tilt latch.

DESCRIPTION OF THE PRIOR ART AND OBJECTIVES OF THE INVENTION

Window latches for double hung windows are well known. Typically, a latch housing is attached to an upper rail of a window sash wherein the latch housing contains a cam moved by a handle in and out of a keeper attached to a lower rail of the adjacent window sash. It is also known to mount the window sashes in a double hung window arrangement such that each sash tilts in and out of engagement with the window frame for the purposes of providing easy access to the window exterior for cleaning and the like. Typically, special latches are attached to the corners of each window sash such that the latches engage slots formed in the interior of the window frame. In another arrangement, the latches are configured to engage a slide rack in the window frame to permit tilting of the window.

Disadvantages of the prior latching arrangements include insecure fastening of the two window sashes via the cam systems, difficult manipulation, a need to overcome great spring tensions to withdraw the window latches from the window tracks, and complicated geared slides which are expensive to manufacture and hard to assemble and install. Moreover, many of the latching mechanisms require additional hardware or modifications to the stiles and rails of the window sashes. Also, assemblies that use racks to engage locking mechanisms must be accurately measured and cut to prevent timing mishaps that occur from welding or fabrication tolerance which lead to malfunction of the lock.

Thus, in view of the problems and disadvantages associated with prior art devices, the present invention was conceived and one of its objectives is to provide an inexpensive, yet easy to operate latch assembly for double hung windows which provides secure locking of tiltable window sashes.

It is another objective of the present invention to provide a locking mechanism with an anti-tilt safety device.

It is still another objective of the present invention to provide a tilt window latch with a gear enmeshed with a rack for operating a distal tilt latch.

It is yet another objective of the present invention to provide a lock with a timing mechanism to prevent over-rotation of the cam.

It is a further objective of the present invention to provide a locking mechanism with a lock handle connected to a cam that engages a strike plate.

It is still a further objective of the present invention to provide an integrated tilt latch/window lock with an integrally formed slide bolt and rack partially encased in a sheath.

It is yet a further objective of the present invention to provide a window lock assembly and tilt latch contained within a gear lodgment in a lock rail and covered with a latch housing.

Various other objectives and advantages of the present invention will become apparent to those skilled in the art as a more detailed description is set forth below.

SUMMARY OF THE INVENTION

The aforesaid and other objectives are realized by providing a latch for a tilt window which is capable of locking and unlocking the window and unlatching the window for tilting purposes. The latch includes a locking mechanism and a rack, the rack having proximal and distal ends. The proximal end of the rack is connected to the locking mechanism while the distal end of the rack is affixed to a slide bolt within a cylindrical sheath. The locking mechanism also includes a cam and a gear, the cam positioned on the gear and the gear enmeshed with the rack so that rotating the gear operates the slide bolt. The latch can be installed on window assemblies of any size from any window manufacturer and as it is a modular construction, it may be installed on a high number of windows in a relatively short period of time.

DETAILED DESCRIPTION OF THE PREFERRED EMBODIMENT AND OPERATION OF THE INVENTION

Figure 1:
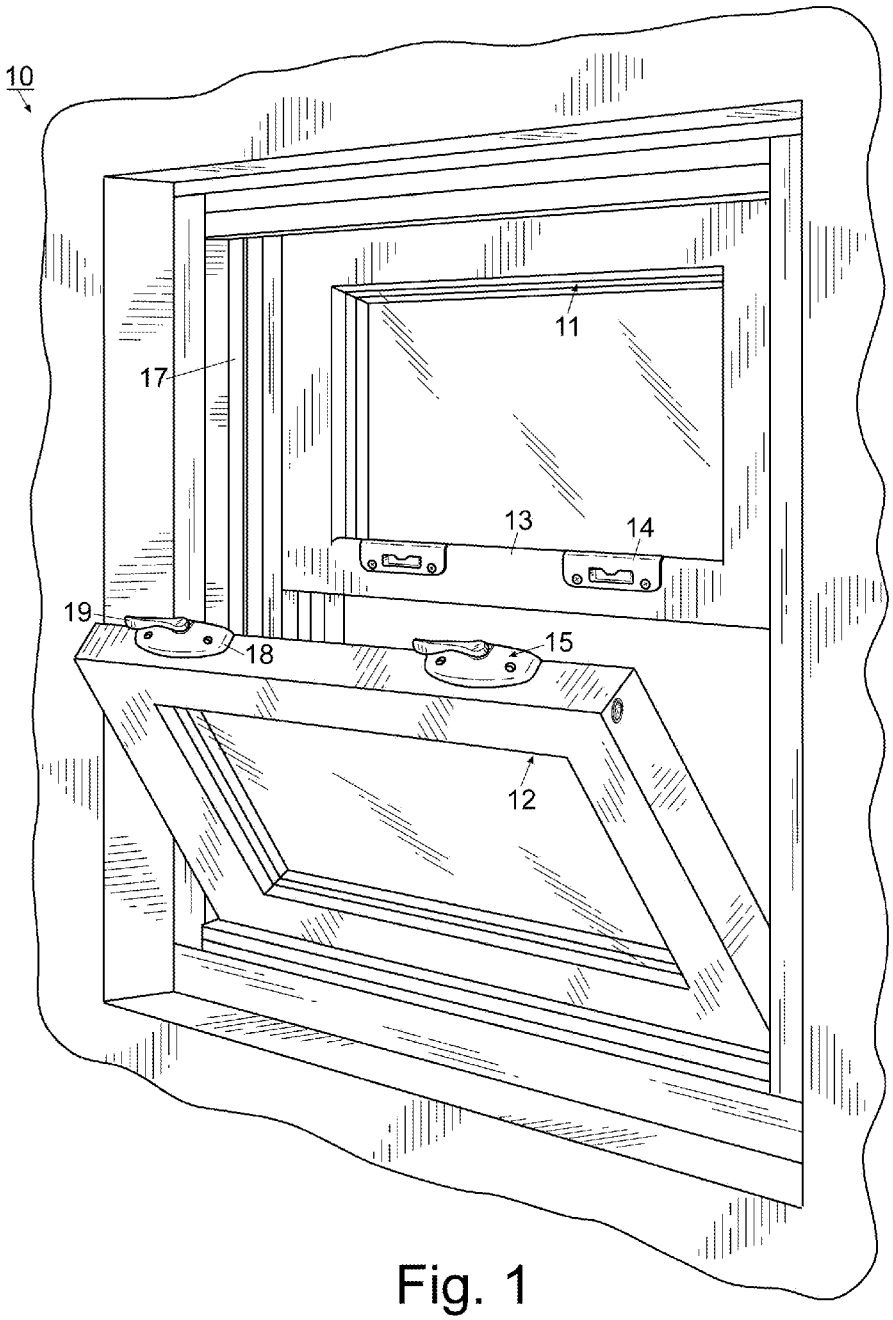
FIG. 1 shows a perspective view of a conventional double-hung tiltable window including a latch disclosed herein.
Figure 2:
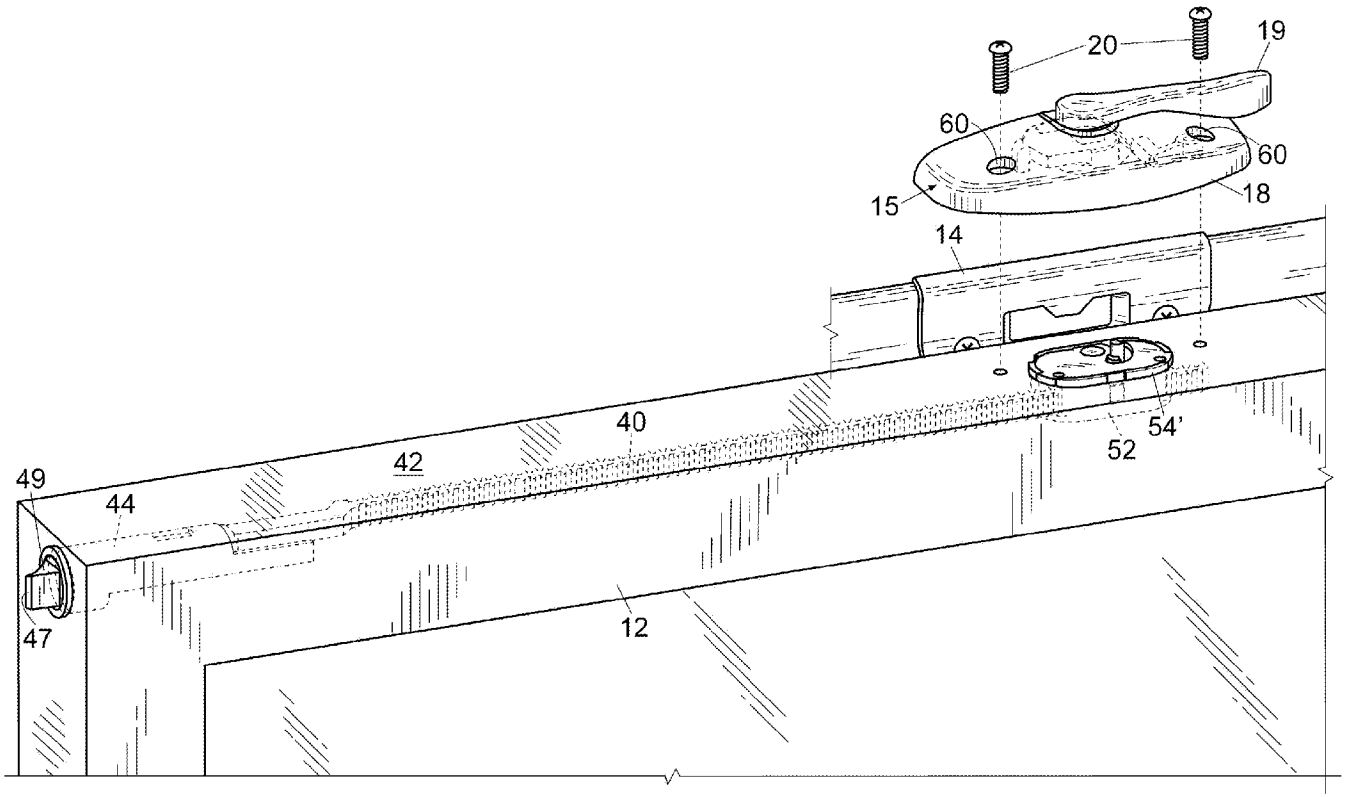
FIG. 2 pictures a partially magnified perspective view of a meeting rail and lock rail with the locking mechanism of FIG. 1 exploded off with other components of the latch shown in dotted line.
Figure 3:
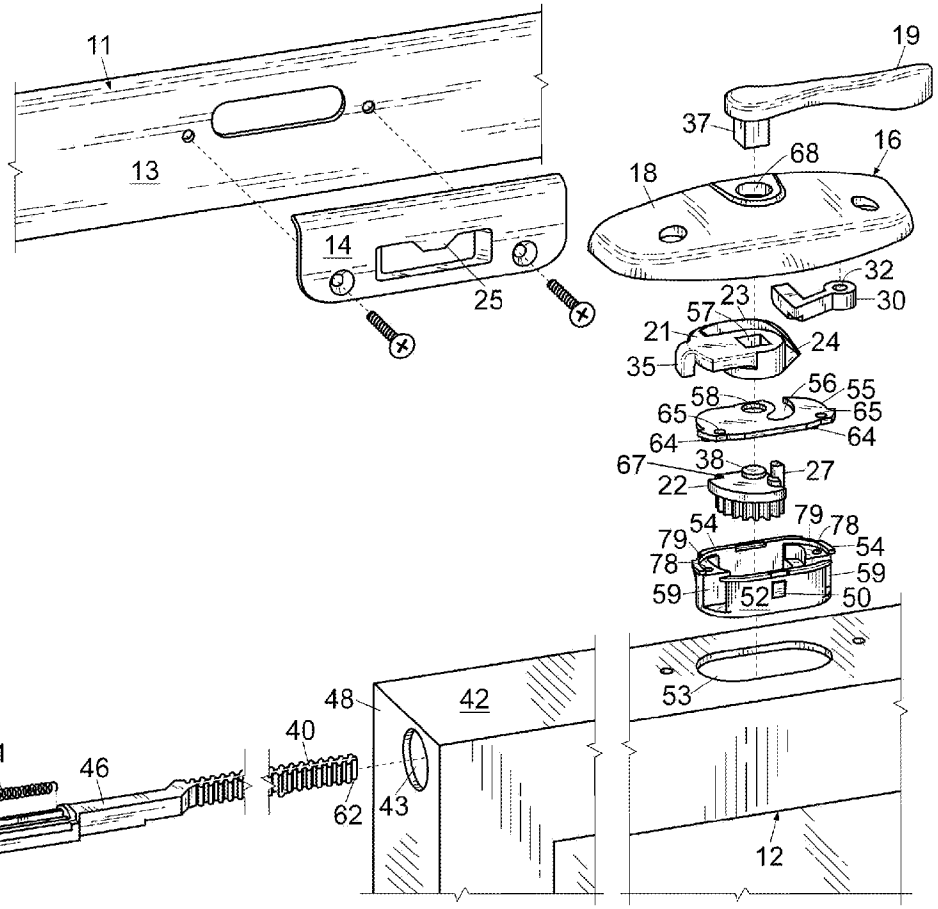
FIG. 3 depicts in exploded fashion a partially conventional upper sash with strike plate, lower sash with lock rail and the components of the latch of FIG. 1.
Figure 4:
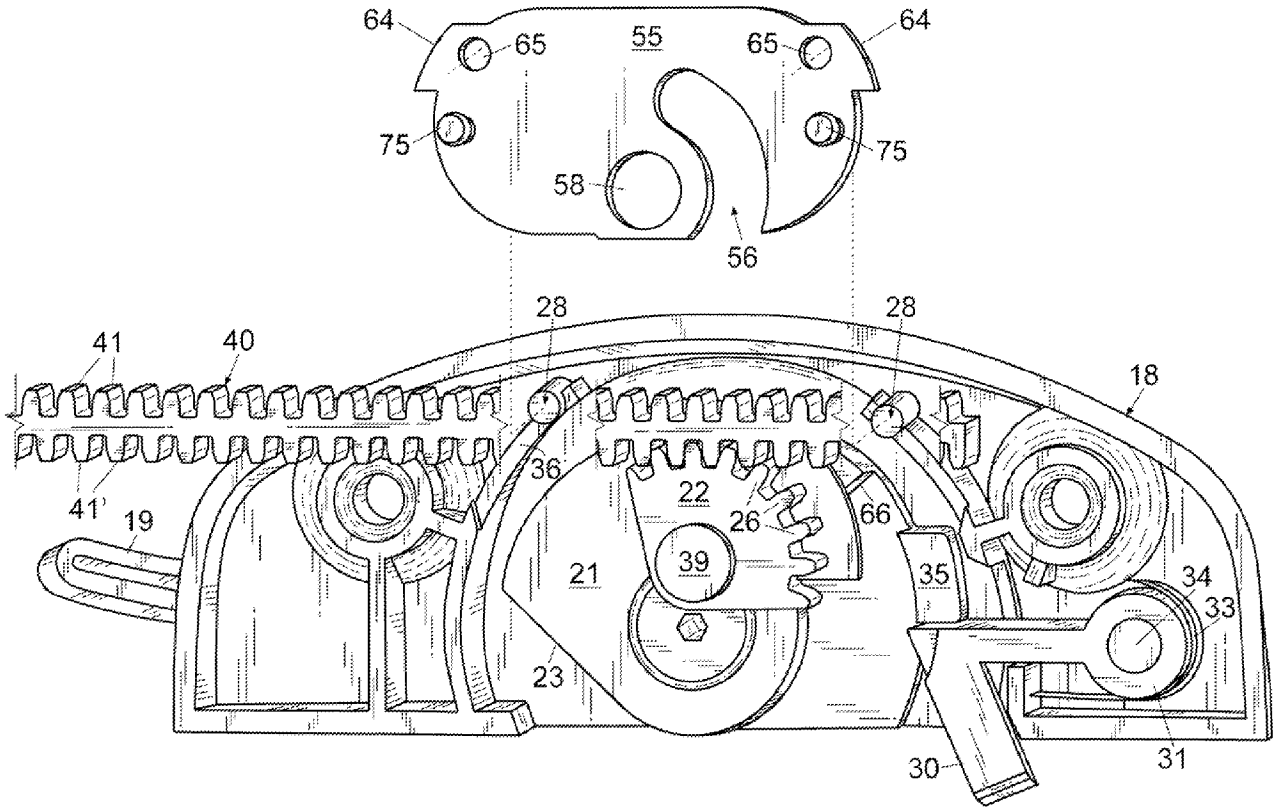
FIG. 4 demonstrates a bottom perspective view of the interior of the latch of FIG. 1 with lodgement top exploded away.

For a better understanding of the invention and its operation, turning now to the drawings, FIG. 1 shows a conventional tilt window 10 having upper sash 11 and lower sash 12 which contains window latch 15. As seen in FIGS. 2, 3, and 4, preferred latch 15 includes handle 19 having post 37, latch housing 18 with opening 68, cam 21 having timing mechanism 35, opening 57 and circular slot 24, anti-tilt member 30 with opening 32, lodgement top 55 with opening 58, arcuate slot 56, a pair of apertures 65 and tabs 64, gear 22 having teeth 26, nodule 38, and post 27 and gear lodgement 52 with discontinuous lip 54 and catches 50 positioned therearound. As shown in FIG. 4, anti-tilt member 30 is affixed on stud 34 within housing 18 with spring 33 which provides tension to anti-tilt member 30. Rack 40 as shown in FIGS. 2, 3, and 4 includes proximal end 62 which is enmeshed with gear 22 and distal end 63 which includes wedge tip 47 on slide bolt 46 which is contained within slide bolt housing 44. Slide bolt 46 also includes bolt spring 51 that biases wedge tip 47 within slide bolt housing 44 to protrude beyond housing lip 45 unless rack 40 is retracted. This bias ensures that wedge tip 47 does not inadvertently disengage from window frame 17. This description includes a single latch 15 for brevity and clarity, but it is understood that more than one latch 15. may be used on a given window as shown in FIG. 1.

Upper sash 11 includes strike plate 14 connected to meeting rail 13. Upper sash 11 is part of a conventional type of tiltable window that rides up and down within window frame 17. Strike plate 14 includes tongue 25 and allows locking mechanism 16 (seen in FIG. 3) of latch 15 to be rotated to secure lower sash 12 to upper sash 11 and prevent vertical movement. As would be understood, upper sash 11 and lower sash 12 are preferably formed from hollow extruded vinyl although aluminum, wood, or other suitable materials may also be used in appropriate circumstances.

Latch 15 as seen in FIGS. 1-4 includes locking mechanism 16 which further includes latch housing 18 with handle 19 pivotally rotatably positioned on the top thereof and fastened therebeneath to cam 21. Handle 19 includes rectangular post 37 which frictionally engages rectangular opening 57 in cam 21 and is affixed thereto by a conventional fastener (not shown) to prevent handle 19 from being lifted and removed from housing 18. Latch housing 18 may be secured to lower sash 12 such as by fasteners 20 (FIG. 2) which are typical threaded members positioned through apertures 60. In an alternate embodiment, latch housing 18 may also be positioned directly on gear lodgement 52 by nesting recess 36 (shown in FIG. 4) around lodgement lip 54', which is thicker than lodgement lip 54 but would still require fasteners 20 for secure engagement to lower sash 12 to prevent latch 15 from becoming misaligned. Cam 21 as shown in FIG. 4 contained within housing 18 can be rotated by handle 19 in a clockwise manner whereby pawl 23 of cam 21 will rotate outwardly to engage strike plate 14 and lock lower sash 12 with upper sash 11. Cam pawl 23 defines circular slot 24 (FIG. 3) which engages tongue 25 of strike plate 14 during the latching process to secure latch 15 and prevent relative movement between upper sash 11 and lower sash 12.

Figure 3A:
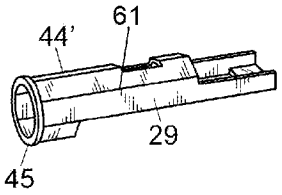
FIG. 3A shows an alternate polygonal embodiment of the slide bolt sheath in FIG. 3 having flat, angular sides.

As shown in FIGS. 2 and 3, rack 40 extends from locking mechanism 16 to rail end 48 of lock rail 42. Lower sash 12 may be hollow to contain the various components of latch 15. Slide bolt housing 44 may be cylindrical in one embodiment and includes lip 45 which surrounds the outside of opening 43 in rail end 48 of lower sash 12 to prevent further penetration of slide bolt housing 44 therein. In an alternate embodiment, slide bolt housing 44' defines a polygonal shape as shown in FIG. 3A. This design allows resulting flat sides 29 to define vertices 61 which frictionally engage opening 43 to prevent rotation of slide bolt 46 and rack 40. Other sheath 44 shapes such as ovals may be used in an alternate embodiment. Slide bolt housing 44 contains bolt spring 51 and slide bolt 46 having wedge tip 47. Wedge tip 47 may be formed with a flat surface but preferably has an arcuate surface that defines scalloped edge 49 (FIG. 2). Wedge tip 47 is biased by spring 51 and engages a track (not shown) of window frame 17 as shown in FIG. 1 to prevent unwanted tilting. In operation, as latch handle 19 is rotated gear 22 turns in engagement with rack 40 to overcome biasing from spring 51 and extend or withdraw wedge tip 47 of slide bolt 46 as required. Gear 22 includes post 27 extending vertically therefrom as shown in FIG. 3. When unlocking latch 15 as handle 19 and cam 21 rotate, the outer edge 66 (FIG. 4) of cam pawl 23 contacts and pushes post 27, causing gear 22 to rotate in the same direction pulling rack 40 inwardly to retract wedge tip 47 to allow lower sash 12 to be pivoted for tilting lower window sash 12 inwardly as shown in FIG. 1.

Rack 40 is generally formed with slide bolt 46 such as by using conventional molding techniques for integral manufacture. Rack 40, slide bolt 46 and wedge tip 47 are made from a conventional polymeric material such as polycarbonate, and in one embodiment each has sufficient torsional flexibility to rotate within lower sash 12 without disengaging from gear 22 in the event that tilt window 10 flexes under duress or high winds as well as sufficient structural memory to return to substantially the same orientation prior to any flexing. Rack 40 includes opposing offset teeth 41, 4F as also seen in FIGS. 3 and 4 which enmesh between corresponding teeth 26 on gear 22 as well as providing rack 40 with increased lateral, longitudinal, and torsional flexibility as compared to racks with teeth 41 on a single side. The above description of rack 40 is only provided from one direction with respect to lower sash 12 but as would be understood opposing teeth 41, 4F allow rack 40 to be inserted in the opposite side of lower sash 12 and enmesh a mirror image of gear 22 engaged with a mirror handle 19 rotating in an opposite direction but in a similar fashion.

As further seen in FIGS. 3 and 4, gear lodgement 52 contains gear 22 which is preferably wedge-shaped as shown in FIG. 4. Gear lodgement 52 is somewhat oval in shape and includes discontinuous surrounding lip 54 around the top edge thereof and defines rack gateways 59 for entry and exit of rack 40 moving therein. In one embodiment of latch 15 lacking posts 28, lip 54 may have increased height to provide a secure engagement for recess 36 on the underside of latch housing 18. Although lip 54 is presented in FIG. 3 in a discontinuous orientation, preferred lip 54 defines a continuous lip. This alternate embodiment of lip 54 is not shown due to the common impediments that exist within lower sash 12 and the hollow associated therewith. Rack gateways 59 align rack 40 in the proper orientation for enmeshing gear 22, which is particularly important when rack 40 experiences flexing or rotation as previously described. Gear lodgement 52 also includes a plurality of catches 50 on the sides thereof (only one shown in FIG. 2) and an opening (not shown) in the bottom thereof for receiving nodule 39 on the bottom of gear 22 for positioning within gear lodgement 52. Within gear lodgment 52 on each end are opposing shelves 79 having apertures 78 therein for receiving opposing posts 75 on one side of lodgement top 55 for alignment and placement of lodgement top 55 in gear lodgement 52. The respective posts and apertures disclosed herein are commonly referred to as operating in a male/female relationship. Although only one such orientation is shown in FIGS. 1-4, the inventor contemplates that this relationship may be reversed should the situation call for such attachment flexibility in one or more alternate embodiments.

During installation, gear lodgement 52 is positioned within lock rail 42 through opening 53 whereby catches 50 engage the underneath side (not shown) of opening 53 and discontinuous lip 54 rests atop opening 53 preventing total insertion within lock rail 42. Once gear lodgement 52 is inserted, catches 50 prevent gear lodgement 52 from falling out of or being easily removed from lock rail 42, referred to as the "floating" position. Gear 22 is then positioned therein between shelves 79 with nodule 39 positioned within the opening (not shown) in the bottom of gear lodgement 52 for proper placement. Next lodgement top 55 is positioned thereover whereby post 27 of gear 22 extends upwardly through arcuate slot 56. Nodule 38 of gear 22 is received within opening 58 of lodgement top 55 and, in one embodiment, opposing posts 75 (FIG. 4) of lodgement top 55 are received within apertures 78 of gear lodgement 52 and lodgement top 55 can then be secured in place using finger pressure on lodgement tabs 64. Housing 18 with cam 21 affixed thereto can then be placed atop lodgement top 55 whereby posts 28 (FIG. 4) are positioned within apertures 65 of lodgement top 55 for secure alignment. Once gear lodgement 52 is inserted into lower sash 12 but before remaining components such as gear 22 are assembled, rack 40 is inserted through gateway 59. Gear 22 is then positioned within lodgement 52 such that gear 22 enmeshes with rack 40 as seen in FIG. 2. Lodgement top 55 is then affixed to gear lodgement 52 by inserting latch housing posts 28 into lodgement holes 65 and lodgement posts 75 into gear lodgement holes 78 for proper placement and operation of handle 19 with the movement of gear 22 and rack 40. Although lodgement top 55 is separated from latch housing 18 and the various components of locking mechanism 16 in FIG. 4 for clarity, it is understood that lodgement top 55 would conceal rack 40 and gear 22 as described in the method section below.

Arcuate slot 56 of lodgement top 55 permits post 27 to extend up from gear 22 and rotatably move therein for contact with cam 21 during rotation of handle 19. Because locking mechanism 16 and slide bolt 46 may operate independently from one another or synchronously, post 27 and arcuate slot 56 combine to allow operation of latch 15 even when handle 19, cam 21, and gear 22 are not aligned on the same vertical plane. As shown in FIG. 3, gear post 27 may be considered offset relative to handle post 37, given that respective posts 27 and 37 do not share the same vertical axis. In this orientation, latch 15 can assume a variety of configurations atop lower sash 12, for example to conserve weather stripping or to accommodate different sash lengths and widths. When appropriately positioned, gear lodgement 52 "floats" within lower sash 12 in that lodgement 52 does not contact the bottom or sides of lower sash 12. This orientation allows rack 40 to pass gear 22 within the hollow of lower sash 12 as well as permits other internal modifications to lower sash 12 such as the addition of aluminum or rebar for structural reinforcement. Latch sheath 44 also "floats" within opening 43 in that sheath lip 45 is the only part of sheath 44 that contacts the top, bottom, or sides of lower sash 12.

Further shown in FIGS. 3 and 4 is anti-tilt member 30 which is rotatably contained within latch housing 18. Anti-tilt member 30 includes eyelet 31 which defines opening 32 for rotation on stud 34 of housing 18. Anti-tilt member 30 can rotate approximately twenty-five degrees) (25° upon engagement with cam 21. Anti-tilt member 30 also includes a biasing member such as spring 33 that prevents anti-tilt member 30 from contacting strike plate 14 or upper sash 11 until engaged by cam 21. During normal operation when lower sash 12 is in a lowered position (i.e. touching the bottom base of window frame 17), anti-tilt member 30 is biased by spring 33 to remain retracted within latch housing 18. Once contacted, anti-tilt member 30 rotatably extends outwardly beyond latch housing 18 and contacts strike plate 14 or upper sash 11, preventing handle 19 from rotating far enough to retract wedge tip 47 with rack 40 and ultimately stopping lower sash 12 from pivoting out of window frame 17. When in this configuration, lower sash 12 manually raised and lowered as desired. When tilting is desired, lower sash 12 is raised a sufficient height to avoid contact with meeting rail 13 whereby handle 19 is fully rotated and positioned as illustrated in FIG. 4. In this position, cam 21 and timing mechanism 35 rotate to contact anti-tilt member 30 causing rack 40 to retract wedge tip 47 from engaging window frame 17 allowing sash 12 to pivot inwardly.

As further seen in FIG. 4 timing mechanism 35 is formed generally to cam 21 such as by using conventional molding techniques. As locking mechanism 16 is installed, rack 40 is inserted into rail end 48 and run through the hollow middle of lock rail 42 whereby proximal end 62 of rack 40 passes through gateway 59 in gear lodgement 52 where it engages gear 22. Conventional locking mechanisms that use racks to operate distal tilt latches must measure the racks accurately to prevent malfunction of the latch mechanism due to variation in the fabrication of the window sill. Gear 22 is oriented and inserted so that flat side 67 on wedge-shaped gear 22 opposite post 27 is flush with gear lodgement 52. Gear teeth 26 are then manually aligned to enmesh with corresponding rack teeth 41. A user can manipulate rack 40 and gear 22 so that no variation in the construction of lower sash 12 will hinder the operation of latch 15.

The preferred method of using tilt window 10 includes the steps of providing latch 15 which includes handle 19, latch housing 18, cam 21, timing mechanism 35, spring 33, anti-tilt member 30, lodgement top 55, gear 22 and gear lodgement 52, the step of placing latch 15 in opening 53 of lock rail 42, and the step of snapping gear lodgement 52 into position. The method further includes the steps of inserting proximal end 62 of rack 40 into opening 43 of lower sash 12 and through lodgement gateway 59, enmeshing rack teeth 41' with gear teeth 26, affixing lodgement top 55 to lodgement 51, and connecting latch housing 18 to lodgement top 55. After installation of latch 15, the method additionally includes the steps of rotating handle 19 approximately one hundred thirty degrees (130°) where a user will feel resistance, vertically raising lower sash 12, further rotating handle 19 to approximately one hundred eighty degrees) (180° to depress wedge tip 47, and pivoting lower sash 12 out of window sash 17. As would be understood to one of ordinary skill in the art, this method results in unlocking and pivoting a lower window out of a window frame. A similar method in the reverse order is understood to result in pivoting a window into a window frame and locking the window into position.

The illustrations and examples provided herein are for explanatory purposes and are not intended to limit the scope of the appended claims.

I claim:

1. A latch for a tilt window comprising a locking mechanism with a rack defining proximal and distal ends and comprising a plurality of teeth positioned between the ends, the rack proximal end connected to the locking mechanism, a bolt affixed to the rack distal end for securing the window within a sash; the locking mechanism including a handle defining a post, a gear defining a post and a plurality of teeth, the gear post offset relative to the handle post, a cam having a timing device formed on an exterior surface thereon, the cam frictionally contacting the gear via the gear post, whereby manually engaging the timing mechanism produces adjustable rotation of the cam and the gear, resulting in cooperative enmeshing of the rack teeth with the gear teeth, whereby rotating the handle from a first position to a second position causes corresponding rotation at the cam and the gear, and whereby rotating the handle from a second position to a third position causes the gear to retract the bolt, the handle orientation at the second position different from the handle orientation at the third position.

2. The latch of claim 1 further comprising a gear lodgement, the gear positioned within the gear lodgement.

3. The latch of claim 2 further comprising a lodgement top engaging the gear lodgement.

4. The latch of claim 3 further comprising a latch housing sized and shaped to receive the cam therein, the handle protruding from the latch housing.

5. The latch of claim 4 further comprising an anti-tilt member positioned within the latch housing.

6. The latch of claim 4 further comprising a housing post positioned on said latch housing, the housing post received by the gear lodgement top.

7. The latch of claim 4 further comprising a recess defined by said latch housing, the gear lodgement engaging the recess.

8. The latch of claim 1 further comprising a bolt sheath, the bolt contained within the bolt sheath.

9. The latch of claim 8 whereby the bolt sheath defines a polygonal shape.

10. A latch for a tilt window within a jamb comprising a window sash defining an internal hollow void with an end in combination with a locking mechanism with a rack defining proximal and distal ends and comprising a plurality of teeth positioned between the rack ends, the rack proximal end connected to the locking mechanism, a bolt affixed to the rack distal end contacting the sash end, the bolt for securing the tilt window within the jamb, the locking mechanism including a handle defining a post, a gear lodgement suspended freely within the hollow void, a gear defining a post and a plurality of teeth and positioned within the gear lodgement, a cam defining a central aperture and having a timing device formed on an exterior surface thereon, the cam directly and frictionally contacting the gear via the gear post, the gear teeth enmeshed with the rack teeth whereby rotating the handle from a first position to a second position causes corresponding rotation at the cam and the gear, and whereby rotating the handle from a second position to a third position causes the gear to retract the bolt, the handle orientation at the second position different from the handle orientation at the third position.

11. The combination of claim 10 whereby manual engagement of the timing mechanism produces adjustable rotation of the gear and the cam resulting in the cooperative enmeshing of the rack teeth with the gear teeth.

12. The combination of claim 10 whereby the gear post is positioned offset relative to the handle post.

13. The combination of claim 10 further comprising a lodgement top engaging the gear lodgement.

14. The combination of claim 13 further comprising a latch housing sized and shaped to receive the cam therein, the handle protruding from the latch housing.

15. The combination of claim 14 further comprising an anti-tilt member positioned within the latch housing.

16. The combination of claim 14 further comprising a housing post positioned on the latch housing, the housing post received by the gear lodgement top.

17. The combination of claim 10 whereby the gear lodgement is slotted for reception of the rack.

18. The combination of claim 17 whereby the slotted gear lodgement defines a pair of arcuate slots sized and shaped for rack reception.

* * * * *